US006926161B2

(12) United States Patent
Miceli et al.

(10) Patent No.: US 6,926,161 B2
(45) **Date of Patent: *Aug. 9, 2005**

(54) REVERSIBLE CHILD RESISTANT CAP AND COMBINATION OF A CONTAINER AND A REVERSIBLE CHILD RESISTANT CAP

(75) Inventors: David A. Miceli, Spencer, TN (US); Joseph A. Miceli, Spencer, TN (US)

(73) Assignee: Tri State Distribution, Inc., Spencer, TN (US)

( * ) Notice: Subject to any disclaimer, the term of this patent is extended or adjusted under 35 U.S.C. 154(b) by 67 days.

This patent is subject to a terminal disclaimer.

(21) Appl. No.: 10/302,954

(22) Filed: Nov. 25, 2002

(65) Prior Publication Data

US 2003/0075519 A1 Apr. 24, 2003

Related U.S. Application Data

(63) Continuation of application No. 10/236,940, filed on Sep. 9, 2002, now Pat. No. 6,523,709, which is a continuation of application No. 09/794,157, filed on Feb. 28, 2001, now Pat. No. 6,446,823.

(60) Provisional application No. 60/185,706, filed on Feb. 29, 2000.

(51) Int. Cl.[7] ..... B65D 41/06; B65D 50/04; B65D 50/08

(52) U.S. Cl. ..... 215/228; 215/222; 215/332

(58) Field of Search ..... 215/228, 222, 215/332, 201, 211, 216, 217, 219, 220, 341, 342

(56) References Cited

U.S. PATENT DOCUMENTS

| | | | |
|---|---|---|---|
| 942,141 | A | 12/1909 | Hoffman |
| 1,435,723 | A | 11/1922 | Mayer |
| 3,344,942 | A | 10/1967 | Hedgewick |
| 3,435,975 | A | 4/1969 | Weigand |
| 3,557,985 | A | 1/1971 | St. Denis et al. |
| 3,612,324 | A | 10/1971 | Malick |
| 3,865,267 | A | 2/1975 | Morris |
| 3,951,289 | A | 4/1976 | Landen |
| 4,387,821 | A | 6/1983 | Geiger |
| 4,452,364 | A | 6/1984 | Kay |
| 4,526,281 | A | 7/1985 | Herr |
| 4,694,968 | A | 9/1987 | Proctor et al. |
| 4,823,967 | A | 4/1989 | Thompson |
| 5,190,178 | A | 3/1993 | Luch |
| 5,449,078 | A | 9/1995 | Akers |
| 5,464,110 | A | 11/1995 | Heyworth |
| 5,579,934 | A | 12/1996 | Buono |
| 5,711,442 | A | 1/1998 | Kusz |
| 5,819,968 | A | 10/1998 | Jones |
| 5,836,465 | A | 11/1998 | King |
| 5,865,330 | A | 2/1999 | Buono |
| 5,899,348 | A | 5/1999 | Konefal et al. |
| 5,924,588 | A | 7/1999 | Brennan |
| 5,927,532 | A | 7/1999 | Traub |
| 5,934,492 | A | 8/1999 | Jones |
| 6,082,565 | A | 7/2000 | Harrold |
| 6,446,823 | B2 | 9/2002 | Miceli et al. |

FOREIGN PATENT DOCUMENTS

| | | | |
|---|---|---|---|
| EP | 0 792 818 | A1 | 3/1997 |

OTHER PUBLICATIONS

International Search Report, PCT/US01/06103, Feb. 27, 2001.

Written Opinion, PCT/US01/06103, Jan. 22, 2002.

*Primary Examiner*—Nathan J. Newhouse

(74) *Attorney, Agent, or Firm*—Waddey & Patterson, P.C.; Phillip E. Walker

(57) ABSTRACT

The present invention relates to a reversible child resistant cap and a closure system having two positions, the first being a child resistant position and the other being a non-child resistant position. The cap is characterized in that it has a closure plane, a circumferential outer skirt for engaging a container, and a circumferential resilient depending inner member.

3 Claims, 10 Drawing Sheets

REVERSIBLE CHILD RESISTANT CAP AND COMBINATION OF A CONTAINER AND A REVERSIBLE CHILD RESISTANT CAP

This is a continuation of application Ser. No. 10/236,940, filed Sep. 9, 2002, now U.S. Pat. No. 6,523,709 which is a continuation of application Ser. No. 09/794,157, filed Feb. 28, 2001, now U.S. Pat. No. 6,446,823, which claims priority to U.S. Provisional Application No. 60/185,706, filed on Feb. 29$^{th}$, 2000, the entireties of which are incorporated by reference herein.

TECHNICAL FIELD AND INDUSTRIAL APPLICABILITY

The present invention relates to a reversible child resistant cap. Specifically, the invention relates to a cap which may be applied to a vial or other container in one of two positions, the first being a child resistant position and the second being a non-child resistant position. The child resistant position provides an obstacle to children being able to remove the cap from the container, whilst the non-child resistant position allows for ready removal of the cap from the container. The present invention also provides a reversible child resistant cap and container assembly.

BACKGROUND OF THE INVENTION

There are many varying types of child resistant closure systems disclosed in the art. An example of a particular type of child resistant closure system is disclosed in U.S. Pat. No. 5,449,078, which relates to a combination of a container and safety cap. The aforementioned patent is herein incorporated by reference.

While many child resistant caps effectively provide protection against the danger of small children being able to remove potentially harmful pills from vials or other containers, they also provide a problem for a considerable portion of the adult population that require medication, however, lack the manual dexterity or strength to remove the child resistant cap. This is of a particular concern to the elderly population or people suffering from arthritis and other disabilitating diseases.

Accordingly, this problem has been addressed by the development of closure systems having a child resistant mode and a non-child resistant mode such that, in the non-child resistant mode, the caps are more easily opened by adults. However, many such caps have a complex, multi part, structure making the caps expensive or the closure systems suffer from the problem of providing an inferior moisture and air barrier when used in the non-child resistant mode. Further, other attempts to develop reversible child resistant closure systems have resulted in caps that when used in their non-child resistant mode tended to come off from the vial or container inadvertently, for example, when being carried in a bag with other articles.

In light of the foregoing, there is a need for a reversible child resistant closure that overcomes the aforementioned deficiencies of the prior art.

SUMMARY OF THE INVENTION

Accordingly, the present invention is directed to a reversible child resistant cap and closure system that substantially obviates one or more of the problems due to limitations and disadvantages of the related art.

Additional features and advantages of the invention will be set forth in the description that follows, and in part will be apparent from the description, or may be learned by practice of the invention. The objectives and other advantages of the invention will be realized and attained by the system particularly pointed out in the written description and claims hereof as well as the appended drawings.

To achieve these and other advantages and in accordance with the purpose of the invention, as embodied and broadly described, the invention provides a reversible child resistant cap. In the first position, or child resistant position, the cap when applied to a container provides an effective protection against children being able to remove the closure, whilst at the same time allow ready removal of the cap by normal adults. In the second position, or the non-child resistant position, the cap allows for easy removal of the cap from the container even by persons whose ability to use their hands is severely limited.

In another embodiment, the present invention also provides a reversible child resistant closure system, comprising the combination of a container and reversible child resistant cap.

In accordance with the invention, the reversible child resistant cap comprises a closure plane, a circumferential outer skirt for engaging a container, and a circumferential resilient depending inner member. The circumferential outer skirt comprises an upper portion extending in an upward direction from the closure plane and a lower portion extending in a downward direction from the closure plane. The upper portion of the circumferential outer skirt comprises a non-child resistant engaging means for engaging a container. The lower portion of the circumferential outer skirt comprises a child resistant engaging means for engaging a container. The circumferential resilient depending inner member has an outer surface that is tapered from a larger diameter portion adjacent the closure plane to a smaller diameter portion remote from the closure plane.

In accordance with another embodiment of the invention, the reversible child resistant closure system comprises a cap and a container. The cap comprises a closure plane and a circumferential outer skirt for engaging the container and having a circumferential resilient depending inner member. The circumferential outer skirt comprises an upper portion extending in an upward direction from the closure plane and a lower portion extending in a downward direction from the closure plane. The upper portion of the circumferential outer skirt comprises a non-child resistant engaging means for engaging the container. The lower portion of the circumferential outer skirt comprises a child resistant engaging means for engaging the container. The circumferential resilient depending inner member has a tapered outer surface that is tapered from a larger diameter portion adjacent the closure plane to a smaller diameter portion remote from the closure plane. The container has a rigid wall having an engaging end for engagement with the cap. The engaging end of the container has an outer surface for engaging the non-child resistant engaging means of the cap. The engaging end of the container also has an inner surface for engaging the tapered outer surface of the cap to provide a seal and a bias on the cap in a direction of removal of the cap. The container also includes means disposed on the container remotely from the engaging end of the container in cooperative means with the child resistant engaging means of the cap.

It is to be understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and together with the description serve to explain the principles of the invention.

DETAILED DESCRIPTION OF THE PREFERRED EMBODIMENTS OF THE PRESENT INVENTION

Figure 1:
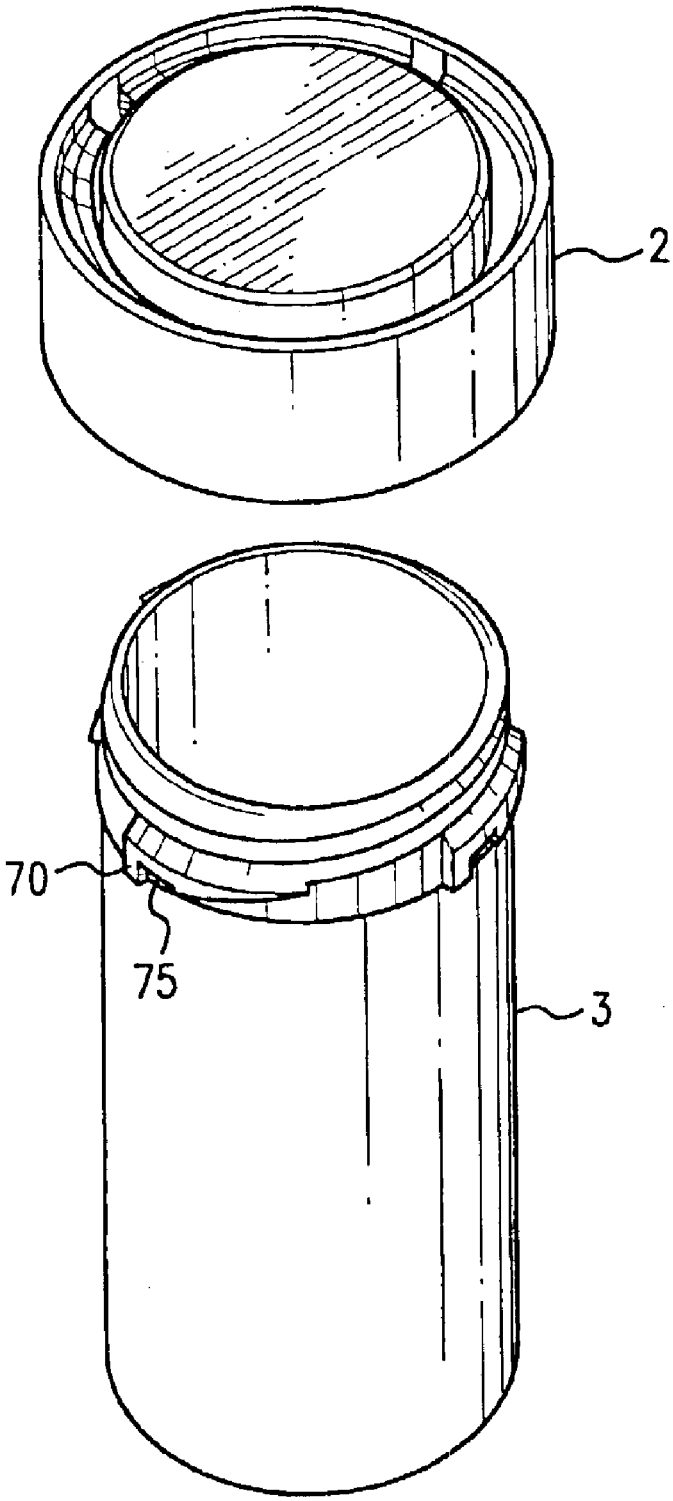
FIG. 1 is a perspective view of an embodiment of the reversible child resistant cap and container assembly in its first child resistant position.
Figure 3:
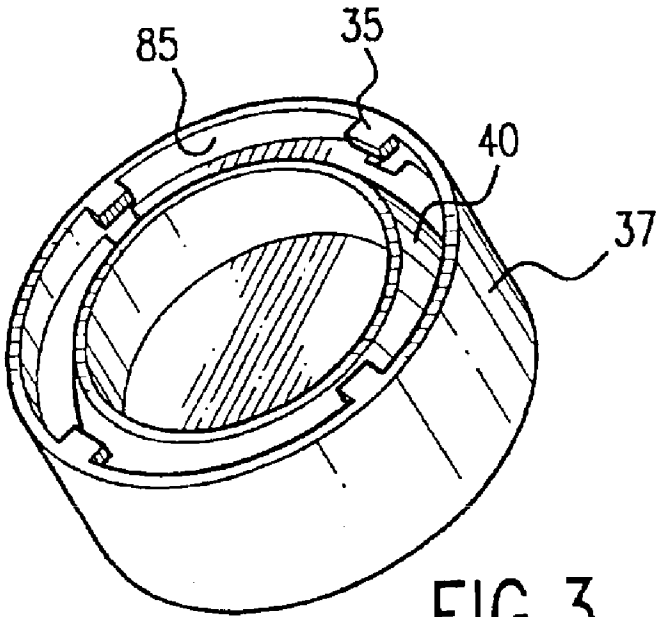
FIG. 3 is a perspective view of the cap of FIG. 1 in its second non-child resistant position.
Figure 2:
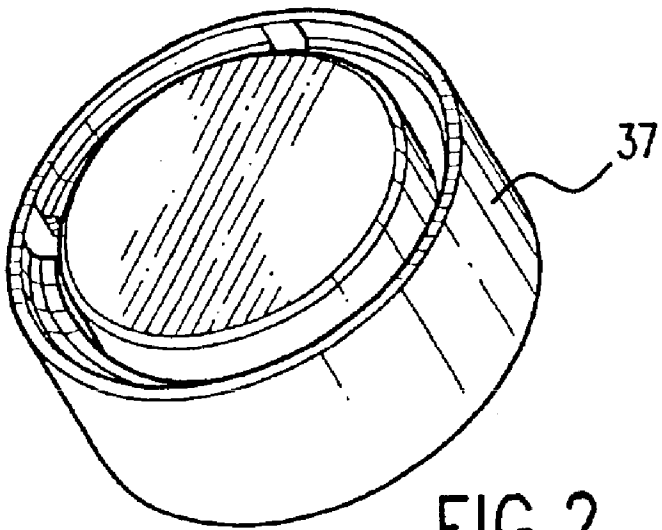
FIG. 2 is a perspective view of the cap of FIG. 1 in its first child resistant position.

Referring now to the drawings of the present disclosure in which like numbers represent the same structure in the various views, a perspective view of an embodiment of the reversible child resistant closure system of the present invention is shown generally at 1 in FIG. 1 and comprises a reversible child resistant cap 2 and a container 3. Specifically, FIG. 1 shows the reversible child resistant closure system in the first child resistant position. Thus, when the closure system is in the first child resistant position the child resistant engaging means of the cap mates with the child resistant engaging means on the container. However, the cap 2 may also be used in an inverted orientation, as shown in FIG. 3, i.e. in a second non-child resistant position. In this second non-child resistant position the non-child resistant engaging means of the cap engage with the non-child resistant engaging means of the container.

Figure 4:
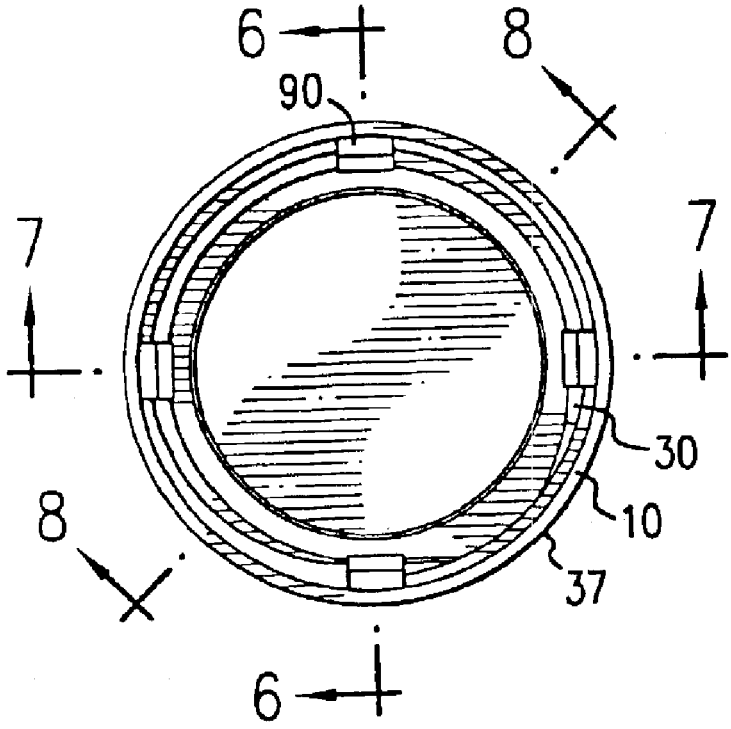
FIG. 4 is a top view of the cap of FIG. 1 in its first child resistant position.
Figure 5:
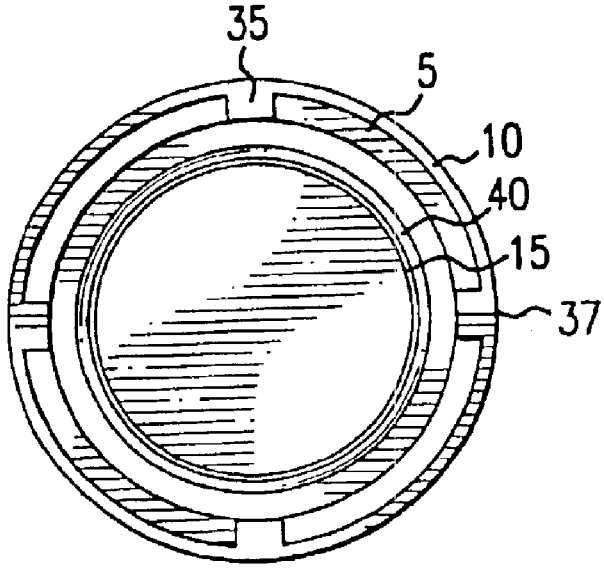
FIG. 5 is a bottom view of the cap of FIG. 1 in its first child resistant position.
Figure 6:
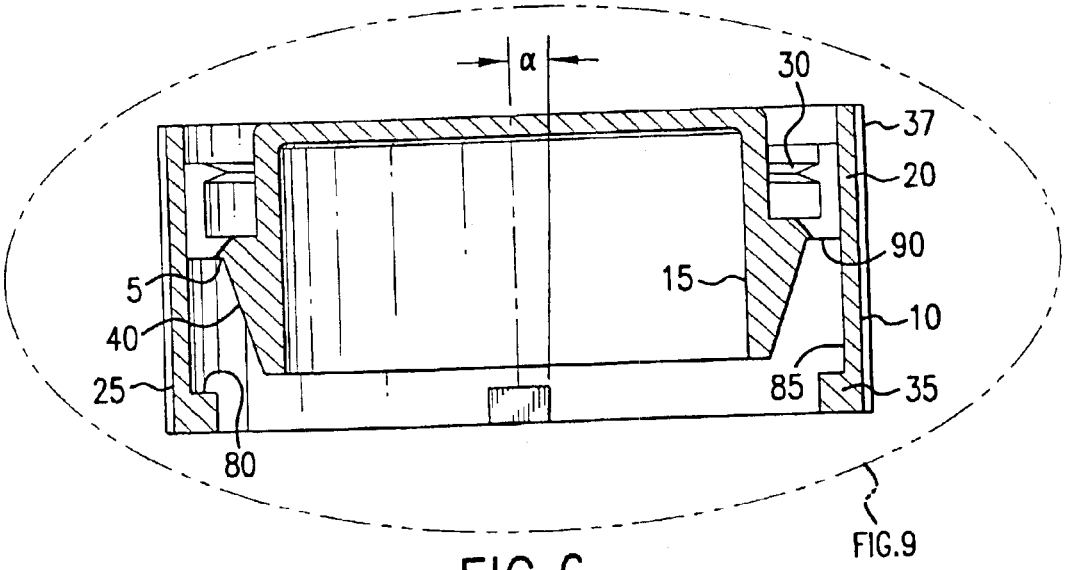
FIG. 6 is a cross sectional view of the cap of FIG. 4 as viewed along line A—A.
Figure 7:
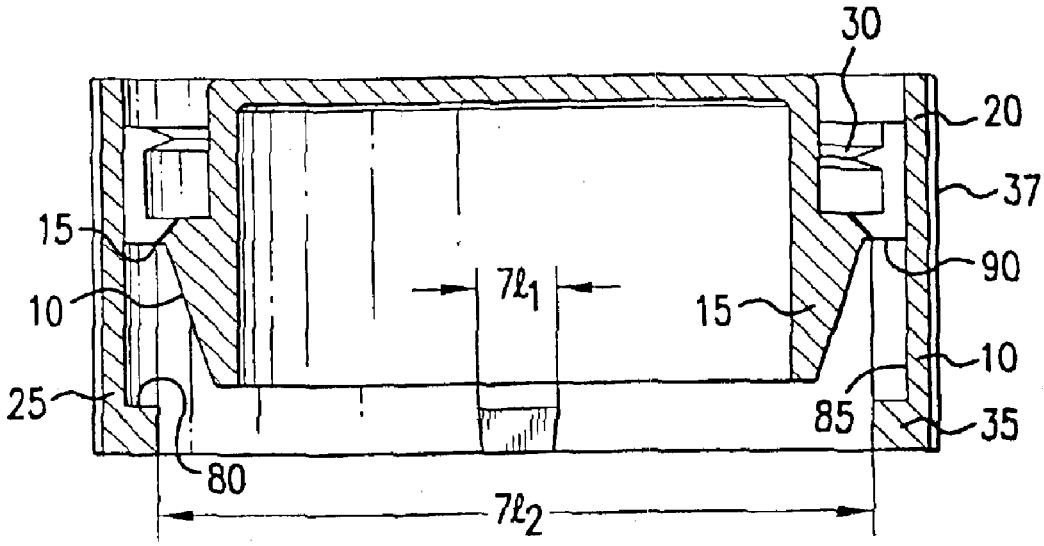
FIG. 7 is a cross sectional view of the cap of FIG. 4 as viewed along line B—B.
Figure 8:
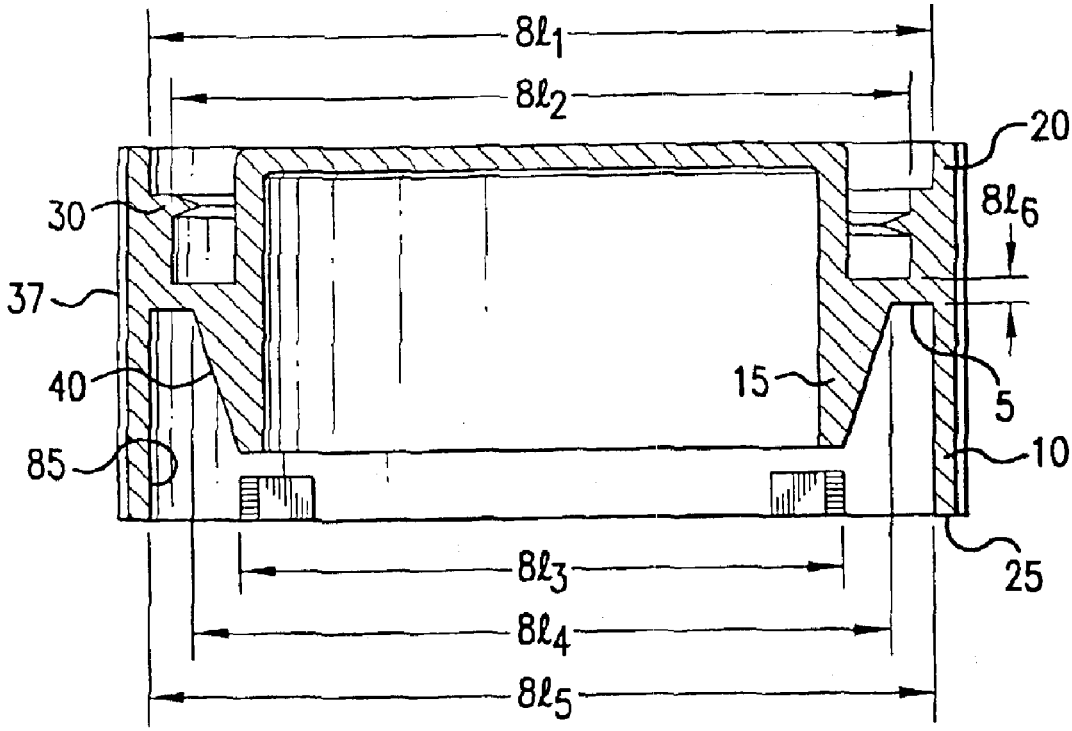
FIG. 8 is a cross sectional view of the cap of FIG. 4 as viewed along line C—C.
Figure 9:
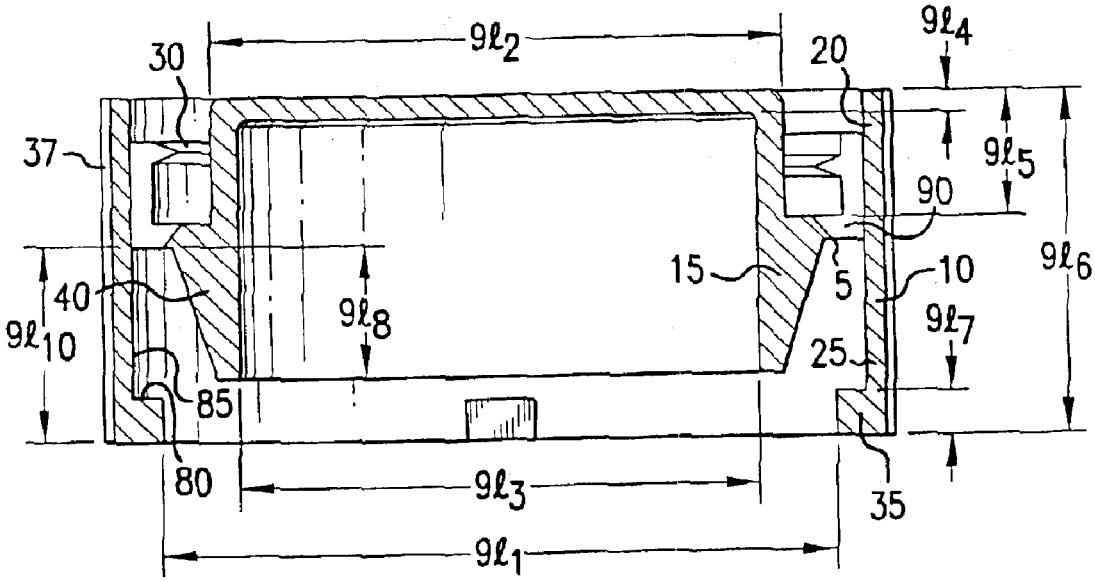
FIG. 9 is a more detailed view of FIG. 6.

FIGS. 6, 7 and 8 are cross sectional views of a preferred embodiment of the cap 2 depicted in FIG. 4. taken along lines A—A, B—B, and C—C respectively. A more detailed view of FIG. 6 is provided by FIG. 9. As shown in FIGS. 4–9, the reversible child resistant cap 2 a closure plane 5, a circumferential outer skirt 10, and a circumferential resilient depending inner member 15.

The circumferential outer skirt 10 comprises an upper portion 20 extending in an upward direction from the closure plane 5. The outer skirt 10 also comprises a lower portion 25 extending in a downward direction from the closure plane 5. The upper portion 20 of the circumferential outer skirt comprises a non-child resistant engaging means for engaging the container. Any suitable non-child resistant engaging means may be used. Suitable examples include an endless closure bead, a thread bead, and a double thread bead. FIGS. 4–9 depict a thread bead 30 as the non-child resistant engaging means, however, a double entry thread bead is preferred. The lower portion 25 of the circumferential outer skirt 10 comprises a child resistant engaging means for engaging the container 3. Any suitable child resistant engaging means may be used. In the preferred embodiment shown in FIGS. 2–9 the suitable child resistant engaging means comprises one or more locking lugs 35.

The circumferential outer skirt 10 may also comprise a gripping means to facilitate rotation of the cap 2 to aid in both putting the cap onto the container and then the subsequent removal of the cap 2. Any suitable gripping means may be utilized. In a preferred embodiment, knerlments 37 are disposed about the outer surface of the outer skirt 10.

The circumferential resilient depending inner member 15 has an outer surface 40 which is tapered from a larger diameter portion adjacent the closure plane 5 to a smaller diameter portion remote from the closure plane 5.

Figure 10:
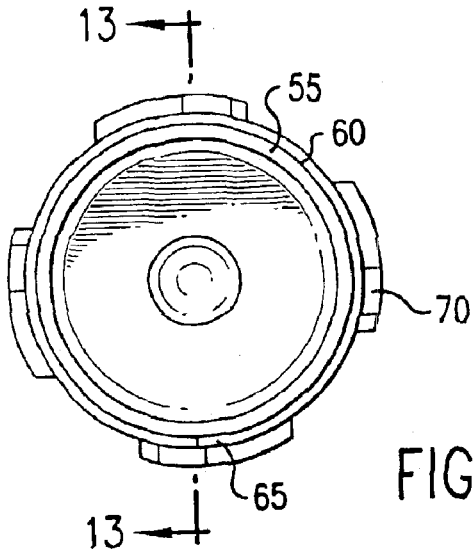
FIG. 10 is a top view of a first embodiment of the container of the present invention.
Figure 11:
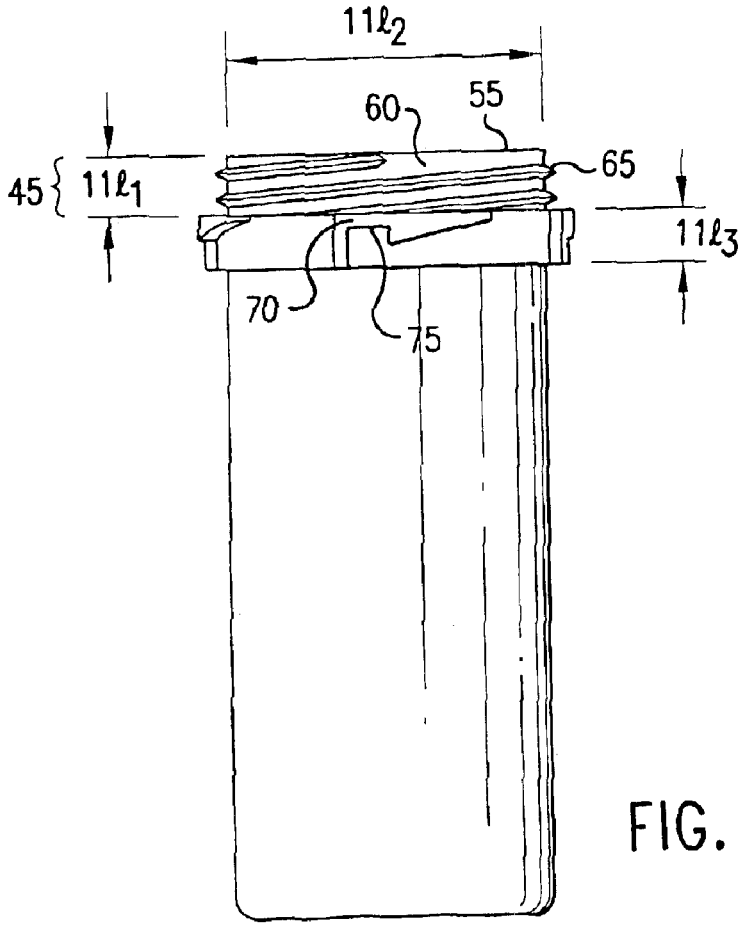
FIG. 11 is a side view of the first embodiment of the container of the present invention.
Figure 12:
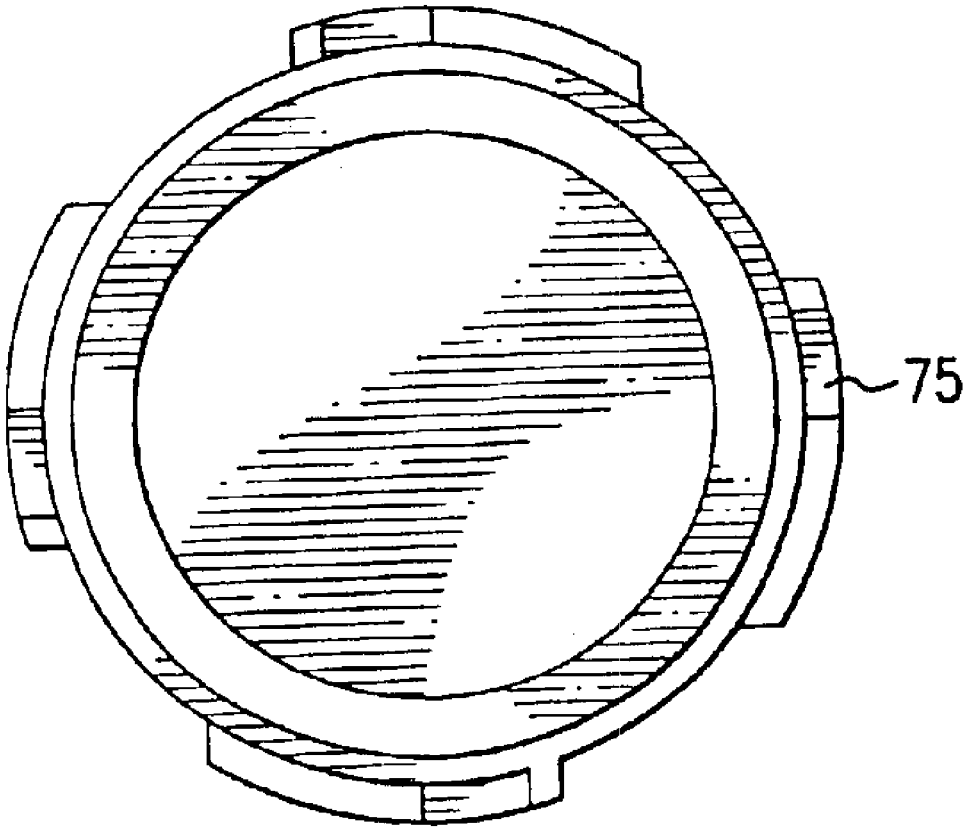
FIG. 12 is a bottom view of the first embodiment of the container of the present invention.
Figure 13:
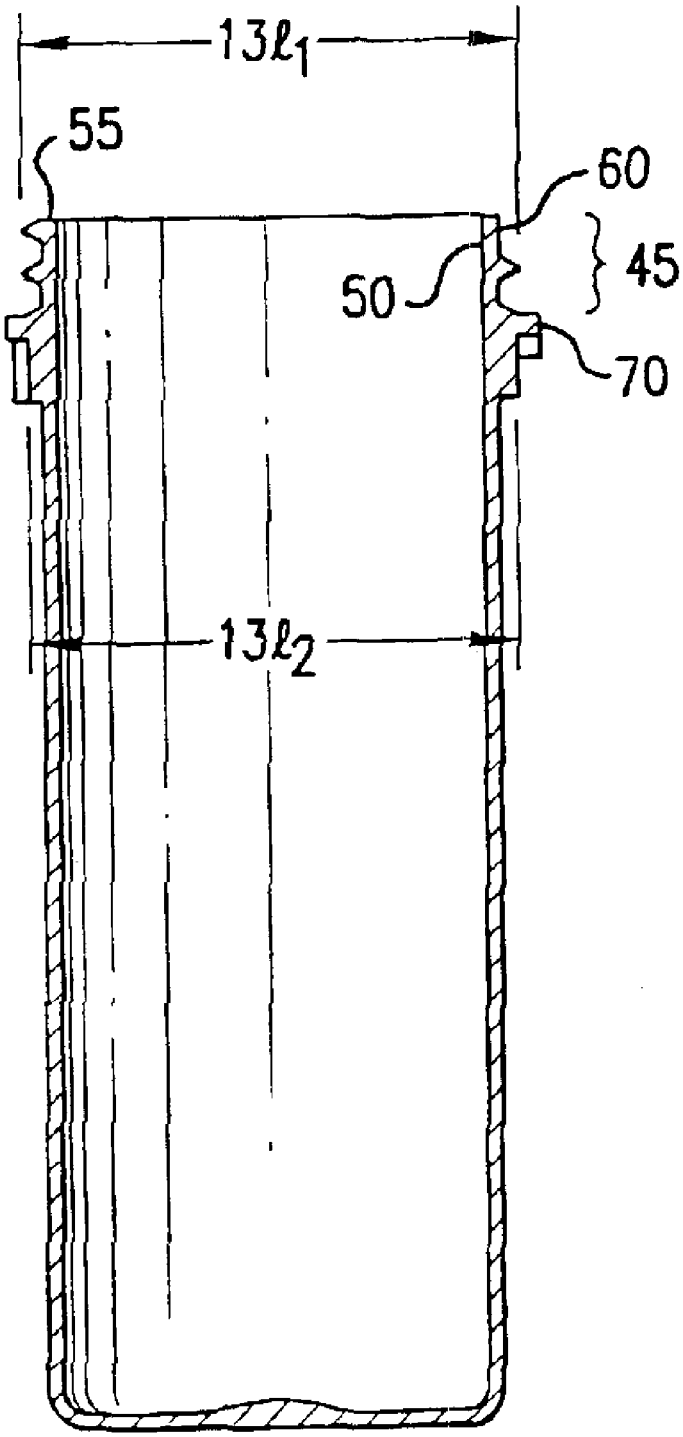
FIG. 13 is a cross sectional view of the container depicted in FIG. 10 as viewed along line E—E.

Referring to FIGS. 11–13, the container 3 has a neck portion 45 having an inner surface 50 for engaging the tapered outer surface 40 of the cap 2. When the closure system of the present invention is used in the first child resistant position, the inner surface 50 engages the tapered outer surface 40 of the cap to provide a seal. Further, the neck portion 45 is preferably made such that when the inner surface 50 engages the outer surface 40, the neck portion 45 bends of flexes in an outward direction to provide a bias on the cap 2 in a direction of removal of the cap 2. The neck 45 may have any suitable construction to provide the bias on the cap 2. For example, the neck 45 may have a thickness sufficiently thin such that the neck 45 flexes or bends in an outward direction when the cap 2 is locked in the first child resistant position. The neck 45 of the container 3 also comprises a top edge surface 55 which contacts the closure plane 5 of the cap 2 when the closure system is in the second non-child resistant position. This contact of the top edge surface 55 and the closure plane 5 is sufficient to form a seal. A non-child resistant engaging means is disposed about the outer surface 60 of the neck 45 to engage the non-child resistant engaging means of the cap 2. Any suitable engaging means may be used. Suitable engaging means may include an endless bead, a thread bead, and a double entry thread bead. As shown in FIGS. 10 and 11, in a preferred embodiment a double entry thread bead 65 is used.

The container 3 also comprises a child resistant engaging means disposed on the container remotely from the neck 45 to cooperate with the child resistant engaging means of the cap 2. In a preferred embodiment, the child resistant engaging means disposed on the container cooperates with the child resistant engaging means on the cap 2 to prevent the cap 2 from being removed from the container without the simultaneous depression and rotation of the cap 2 on the container 3. Referring now to FIG. 11 the child resistant engaging means on the container 3 comprises a camming latch 70 having a cam receiving notch 75 therein and in which the child resistant engaging means on the cap 2 comprises a locking lug 35 which is guided into the notch 75 upon rotation of the cap 2 on the container 3 when the cap 2 is applied to close and seal the container 3 in the first child resistant position.

Figure 14:
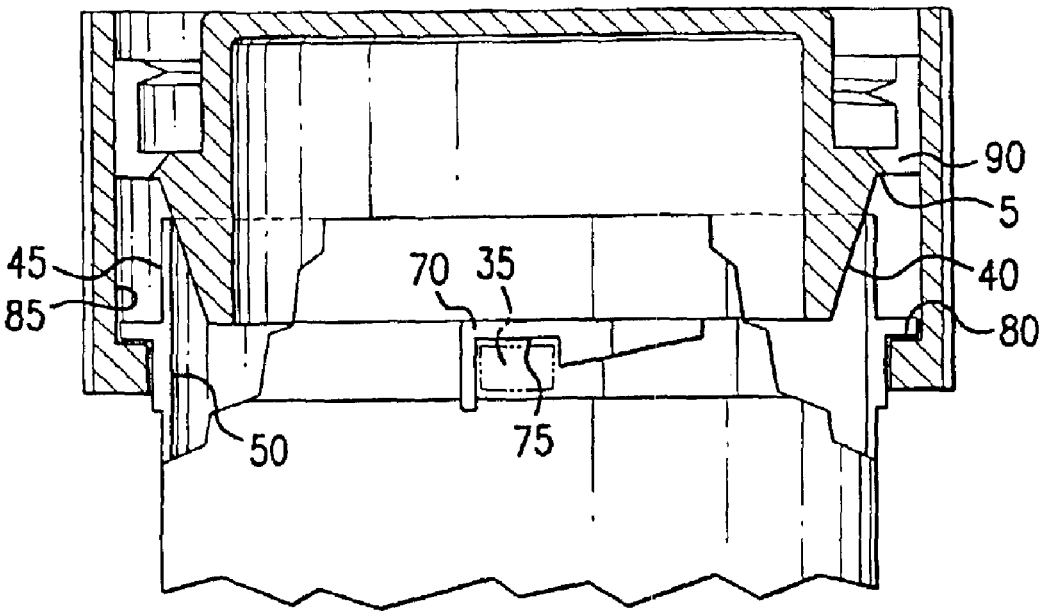
FIG. 14 is a fragmentary elevational view, partly in sectional, of the container and the neck thereof with the cap thereon in a locked and sealed position.

FIG. 14 represents the cap 2 on the container 3 in is first child resistant position with the locking lug 35 seated in notch 75 so that the cap 2 is locked on the container 3. The tapered outer surface 40 of the cap is disposed inside the inner surface 50 of the neck 45 of the container 3 causing an upward bias on the cap 2. Accordingly, the cap cannot be removed from the container merely by rotating the cap 2. Instead, the cap 2 must be depressed on the container to unseat the lock lug 35 from the notch 75 and then rotated in a counter clockwise direction so that the lock lug can be positioned between camming latch 70 and the next adjacent camming latch, so that the cap 2 can be removed by then directly upward motion.

In a particularly preferred embodiment, the cap 2 and the container 3 of the present invention have the following dimensions $7/_1$, $7/_2$, $8/_1$, $8/_2$, $8/_3$, $8/_4$, $8/_5$, $8/_6$, $9/_1$, $9/_2$, $9/_3$, $9/_4$, $9/_5$, $9/_6$, $9/_7$, $9/_8$, $9/_{10}$, $11/_1$, $11/_2$, $11/_3$, $13/_1$, and $13/_2$ as depicted in FIGS. 7, 8, 9, 11 and 13. In a more preferred embodiment angle $\alpha$ as depicted in FIG. 6 is about 3 degrees. In an even more preferred embodiment, some or all dimensions $7/_1$, $7/_2$, $8/_1$, $8/_2$, $8/_3$, $8/_4$, $8/_5$, $8/_6$, $9/_1$, $9/_2$, $9/_3$, $9/_4$, $9/_5$, $9/_6$, $9/_7$, $9/_8$, $9/_{10}$, $11/_1$, $11/_2$, $11/_3$, $13/_1$, and $13/_2$ are 0.125, 1.184, 1.313, 1.254, 1.010, 1.160, 1.314, 1.204, 1.020, 0.950, 0.040, 0.230, 0.615, 0.075, 0.230, 0.345, 0.150, 1.076, 0.090, 1.190, and 1.190 mm respectively.

Any suitable method known to one of ordinary skill in the art may be used to manufacture the cap 2 and container 3 of the present invention. However, to aid in the manufacture of the cap 2 of the present invention, comprising a locking lug 35, the cap 2 preferably comprises molding holes 90 positioned above each locking lug 35 such that portions of an upper mold may pass through the molding holes to form the top surface 80 of the locking lug 35. To retain the moisture and air barrier properties of the closure system, the molding holes 90 are positioned between the outer surface of the skirt 10 and the position at which the closure plane 5 contacts the top edge surface 55 of the container 3 when the cap 2 is applied to the container 3 in the second non-child resistant position. The use of molding holes 90 also enables the locking lug 35 to protrude a greater amount from the inner surface 85 of the lower portion 25 of the skirt 10 than would otherwise be achievable. In addition, the molding holes also allows the locking lug 35 to have a top surface 80 that is substantially perpendicular to the inner surface 85 of the lower portion 25 of the outer skirt 10.

Preferably, the cap is linerless, but liners may be provided if desired. The cap is preferably made from a plastic material, such as high density polyethylene (HDPE) or polypropylene. The container is preferably made from a plastic material, such as low density polyethylene (LDPE) or polypropylene. More preferably, the container is made from polypropylene. The skilled artisan, having the benefit of the instant disclosure, will readily appreciate that the caps and containers may be made from other suitable materials.

Numerous alterations of the structure herein disclosed will be apparent to one of ordinary skill in the art. However, it is understood that the present. disclosure relates to preferred embodiments of the invention for the purposes of illustration only and should not be construed as to be a limitation of the invention. All such modifications and alterations which do not depart from the spirit of the invention are intended to be included within the appended claims.

What is claimed is:

1. A reversible child resistant cap for use with a container, the cap having a child resistant mode when applied to the container in a first child resistant position and having a non-child resistant mode when applied to the container in a second non-child resistant position, the cap comprising:

a closure plane;

a circumferential outer skirt comprising an upper portion extending in an upward direction from the closure plane, a lower portion extending in a downward direction from the closure plane, each of the upper and lower portions including an inner surface;

wherein the inner surface of the upper portion of the circumferential outer skirt comprises a non-child resistant engaging means for engaging the container, and wherein the inner surface of the lower portion of the circumferential outer skirt comprises a child resistant engaging means for engaging the container; and an inner skirt inside the circumferential outer skirt, the inner skirt having an upper end and a lower end, the upper end being closed and the lower end being open;

wherein the upper portion of the circumferential outer skirt has an upper end, and the closed upper end of the inner skirt is positioned at substantially the same distance from the closure plane as the upper end of the circumferential outer skirt.

2. The cap in accordance with claim 1, further comprising:

an annular gap between the closed upper end of the inner skirt and the inner surface of the upper portion of the circumferential outer skirt.

3. The cap in accordance with claim 1, wherein the closed upper end of the inner skirt is circular.

* * * * *